United States Patent [19]

Dürr et al.

[11] 4,390,285

[45] Jun. 28, 1983

[54] METHOD AND APPARATUS FOR MIXING SOLIDS WITH LIQUIDS, IN PARTICULAR FOR GLUING WOOD CHIPS

[75] Inventors: Herbert Dürr, Viernheim; Werner Christen; Helmut Müller, both of Mannheim, all of Fed. Rep. of Germany

[73] Assignee: Draiswerke GmbH, Mannheim, Fed. Rep. of Germany

[21] Appl. No.: 292,213

[22] Filed: Aug. 12, 1981

[30] Foreign Application Priority Data

| | | | |
|---|---|---|---|
| Aug. 24, 1980 | [DE] | Fed. Rep. of Germany | 3032039 |
| Sep. 26, 1980 | [DE] | Fed. Rep. of Germany | 3036346 |
| Feb. 16, 1981 | [DE] | Fed. Rep. of Germany | 3105549 |

[51] Int. Cl.[3] ..... B01F 5/04; B01F 7/04

[52] U.S. Cl. ..... 366/168; 366/102; 366/172

[58] Field of Search ..... 366/154, 155, 165, 167, 366/168, 172, 173, 156, 157, 177, 40, 33, 30, 101, 102, 106, 107, 150

[56] References Cited

U.S. PATENT DOCUMENTS

| | | | |
|---|---|---|---|
| 3,162,428 | 12/1964 | Lodige | 366/173 |
| 3,355,106 | 11/1967 | Graham | 366/173 |
| 3,522,934 | 8/1970 | Walter | 366/154 |
| 4,015,829 | 4/1977 | Forster | 366/154 |

*Primary Examiner*—Robert W. Jenkins

*Attorney, Agent, or Firm*—Browdy and Neimark

[57] ABSTRACT

A system for mixing of wood chips or the like with glue which involves an intensive movement of the chips during the addition of the glue and a subsequent thorough mixing of the glue and the chips in a ring of material to be mixed, is characterized by steadily accelerating the chips out of an axial motion via a centrifugal and helical motion and by the addition of the glue during this acceleration, the acceleration to the velocity of the ring of material to be mixed taking place only following the addition of the liquid.

14 Claims, 7 Drawing Figures

METHOD AND APPARATUS FOR MIXING SOLIDS WITH LIQUIDS, IN PARTICULAR FOR GLUING WOOD CHIPS

FIELD OF THE INVENTION

The invention relates to a method and apparatus for mixing particulate solids and liquids, especially for mixing liquid glue and wood chips or the like where there is intensive movement of the chips while the glue is added and a subsequent thorough mixing of the glue and the chips in a ring of mixed material. Such an apparatus has a mixing vessel in which a mixing shaft capable of being driven at high speed and equipped with mixing tools is coaxially disposed. The vessel is provided at one end, in the vicinity of an induction zone, with a material feed funnel and at the other end with a material outlet funnel. In an area following the induction zone, the mixing vessel is provided with at least one glue feed device. A mixing zone in which the glued chips are mixed in a ring of mixing material is disposed still farther from the induction zone.

BACKGROUND OF THE INVENTION

Methods and apparatus of this kind are known from German Pat. No. 20 57 594 and from U.S. Pat. No. 3,724,471. These mixers for gluing wood chips have revolutionized chip gluing, because an extremely fine distribution of the glue on the surface of the chips took place in such mixers in a minimum of space and at a maximum intensity. This produced a significant saving of glue as well as of plant costs in comparison with previously conventional, high-volume axial or centrifugal and helical mixers. The mechanism of operation in these so-called ring mixers is such that the material to be mixed is accelerated by a mixer driven far faster than critical speed such that the material moves in a helical pattern, in the form of a relatively thin ring of material, on the inner wall of the mixing vessel. The glue is introduced directly into this ring of material. In the forms of embodiment described in the documents cited, the glue is introduced through the hollow mixing shaft and through liquid feed pipes radially extending from the shaft and dipping into the ring of material to be mixed. In another form of embodiment, described in German Pat. No. 21 34 305, the glue is introduced through liquid feed pipes which are fixed in the vessel wall in a locally stationary manner and pass through the vessel wall into the interior of the mixing vessel; the outlet openings of these liquid feed pipes terminate in the ring of material to be mixed.

Despite the substantial advantages attained in terms of structure, apparatus and engineering methods by the gluing mixer described above, the disadvantage remained that a large proportion of the wood chips was damaged by the extremely large acceleration forces, which caused an undesirable reduction in the quality of the particle boards made from such chips.

This was true particularly in the case of inferior woods.

SUMMARY OF THE INVENTION

It is accordingly an object of the invention to provide for improved mixing of solids and liquids without damage to the solids; another object of the invention is to create a method of the general type described above and an apparatus of the general type described above, wherein damage to the wood chips is precluded to the greatest possible extent and wherein better distribution of the glue is attained.

A key feature of the invention is that the acceleration of the chips is extended over a relatively long period of time, in comparison with known ring mixers; that is, it takes place relatively slowly. The forces of acceleration, which could cause possible damage to the chips, are thereby substantially reduced. There is thus a continuous acceleration, stretched out over time, with a transition from an axial mixing motion to an annular mixing motion by way of an intermediate centrifugal and helical motion. The introduction of the glue occurs in part still during the axial mixing movement of the chips and then during the centrifugal and helical mixing movement of the chips; in other words, even while the glue is being introduced, it is not necessary to exert any mechanical forces by way of bottlenecks or the like in order to distribute the glue among the chips. On the other hand, however, the addition of glue is followed by the advantageous, highly intensive distribution of glue on the surface of the chips in a ring of material being mixed. The conical widening of the mixing vessel in the acceleration zone furnishes the necessarily enlarged volume of space in which the chips are able to spread out from the relatively dense packet characterizing the axial mixing phase to a less-dense volume characterizing the centrifugal and helical mixing phase. Subsequent to this, a sufficiently large radius of the mixing vessel is again available in the mixing zone; this is of course necessary so that the tangential accelerations required for the formation of the ring of mixing material will be generated. Again, the manner of glue feeding the acceleration zone makes it possible to use the known means of glue feeding by means of pressure nozzles; this has the substantial advantage that the glue can be used with a smaller proportion of water than was previously conventional. The previously conventional ratio of dry glue compound to water was 1:1. This reduction of the water content means that the water content of the wood chips can be correspondingly higher; the drying of the wood chips, which is associated with high energy consumption, can thus be terminated somewhat earlier than has previously been possible.

Numerous further advantages and features of the invention will be more apparent from the following detailed description of two exemplary embodiments taken in conjunction with the drawings.

Figure 1:
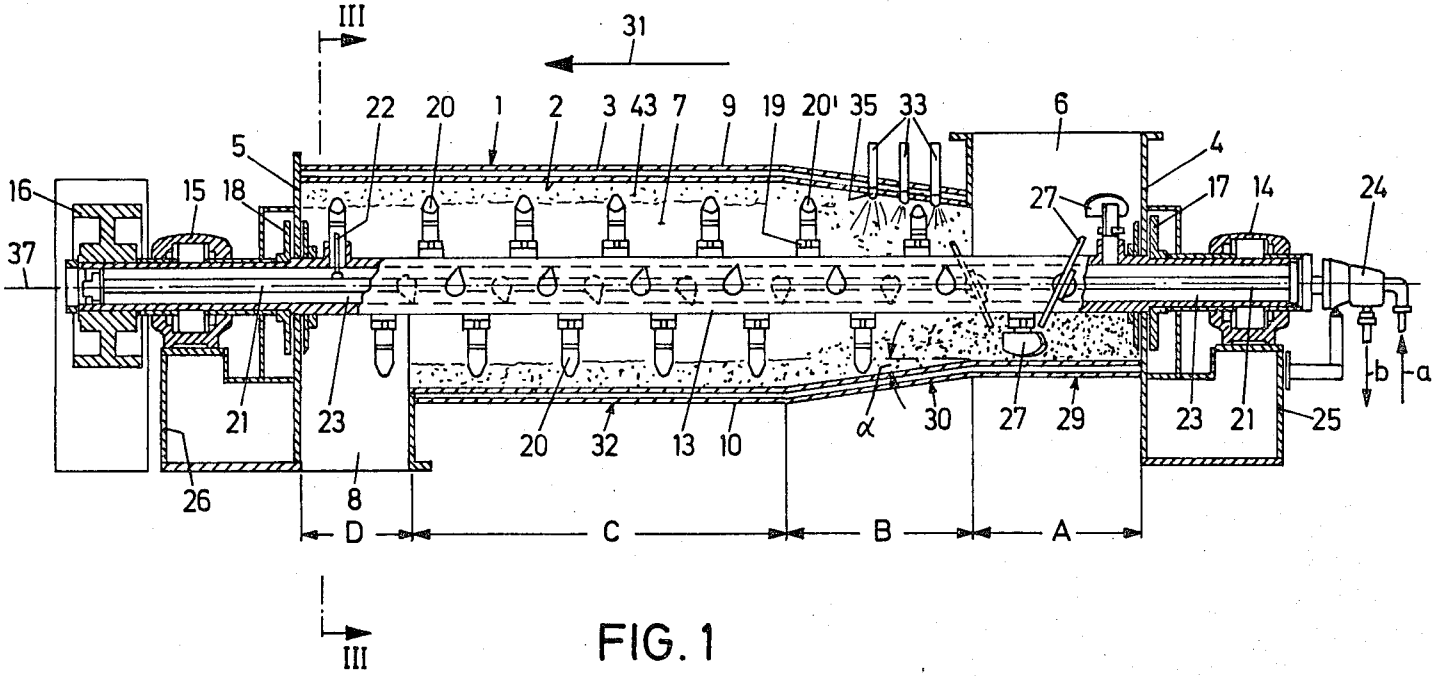
FIG. 1 shows a mixer in accordance with the invention in vertical lengthwise section.
Figure 2:
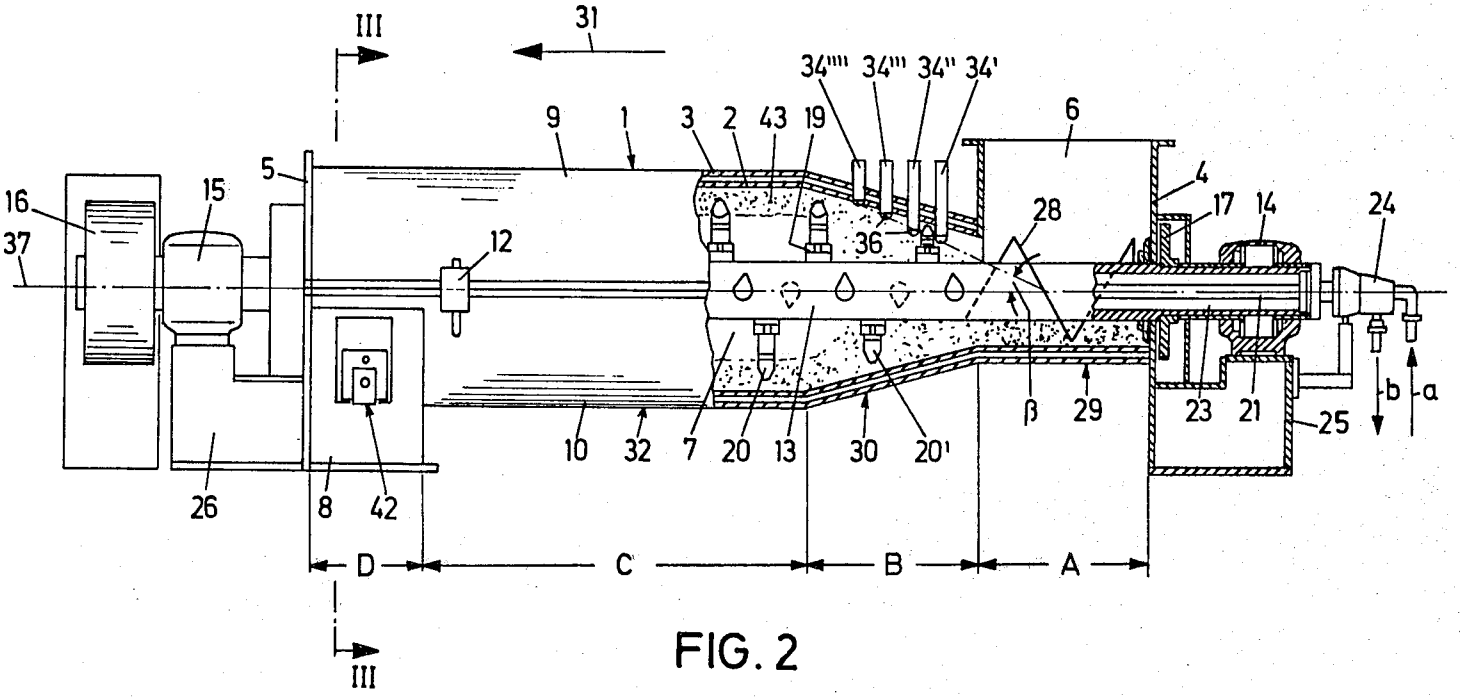
FIG. 2 shows a modified mixer in accordance with the invention in partial lengthwise section.

Since the mixers shown in the drawings are only different in the area of the drawings which lies to the right, the mixer shown in FIG. 2 is depicted as closed in the areas corresponding with FIG. 1.

DESCRIPTION OF THE PREFERRED EMBODIMENTS

The mixers each have a mixing vessel 1, which comprises an inner trough 2 forming the inner wall thereof and a cooling jacket 3 surrounding the inner trough 2 and forming the outer wall. The mixing vessel 1 is closed at either end by bulkheads 4, 5. At one end of the mixing vessel 1 (on the right in FIGS. 1 and 2), a material feed pipe 6 is provided which discharges into the interior 7 of the mixing vessel, which is enclosed by the inner trough 2 and the bulkheads 4, 5, at a tangent from the top. On the other end (on the left in FIGS. 1 and 2), a material outlet pipe 8 is provided which likewise discharges at a tangent from the interior. The mixing vessel 1 is divided in half along the horizontal plane; the upper half 9 and the lower half 10 of the mixing vessel 1 are held together in a manner such that they can be released and swung open by means of hinges 11 on one long side and toggle lever closures 12 on the opposite long side.

A mixing shaft 13 is disposed coaxially within the mixing vessel 1, being supported in bearings 14, 15, and is drivable by an electromotor, not shown, via a V-belt pulley 16 attached in a rotationally fixed manner to the mixing shaft 13. Load-compensating plates 17, 18 are also disposed on the mixing shaft 13 outside the mixing vessel 1 itself but in the vicinity of the bulkheads 4, 5. Threaded sockets 19 are attached to the mixing shaft 13, and hollow mixing tools 20 are threadedly inserted into them. A coolant supply pipe 21 is disposed within the mixing shaft 13 and rotates with it; a coolant pipe 22 branches off from the supply pipe 21 into each hollow mixing tool 20, so that the coolant flows through the coolant supply pipe 21, the branching coolant pipes 22 and the interior of each mixing tool 20 into the annular chamber 23 located between the coolant supply pipe 21 and the mixing shaft 13. The coolant reaches the interior of the mixing shaft 13 via a coolant pipe coupling 24 (provided on the right in FIGS. 1 and 2); the inflow into the coolant supply pipe 21 is indicated by arrow a, and the coolant outflow from the annular chamber 23 is in the direction indicated by arrow b. The bearings 14, 15 are mounted on bearing bases 25, 26.

The region of the mixing vessel 1 over which the material feed pipe 6 extends in the longitudinal direction of the mixing vessel 1 is embodied in cylindrical form and creates an induction zone A for the material to be mixed, conventionally wood chips. So-called induction tools are attached to the mixing shaft 13 in this induction zone A; in the case of the exemplary embodiment shown in FIG. 1, the induction tools 27 are vanelike in embodiment, while in the exemplary embodiment shown in FIG. 2, there is a helical induction tool 28. The induction tools 27 or 28 serve to propel the mixing material falling through the material feed pipe 6 into this cylindrical portion 29 of the mixing vessel 1 in a primarily axially directed movement into the next adjacent, conically embodied portion of the mixing vessel. This portion 30, which widens in conical or more specifically frustoconical fashion in the direction 31 in which material passes through the vessel 1, forms an acceleration zone B for the material to be mixed. This conical portion 30 is followed by a portion 32 of the mixing vessel 1 which is again cylindrical; this portion 32 forms a mixing zone C extending up to the material outlet pipe 8 and an expulsion zone D extending over the axial length of the material outlet pipe 8. The conical portion 30 widens from radius $r_{29}$ to radius $r_{32}$ of the cylindrical portion 32. The ratio of the radii $r_{29}$ to $r_{32}$ amounts to between 0.6 and 0.8 to 1 and is preferably 0.75 to 1.

The apex angle $\alpha$ of the conical portion 20 is approximately 8° to 15° and preferably approximately 10°. The axial length of acceleration zone B has a ratio to mixing zone C of approximately 1:2. In accordance with the conical path of the inner wall of the mixing vessel 1 in the conical portion 30, the mixing tools in this region have a substantially shorter radial length than in the cylindrical portion 32. For this reason, the mixing tools in this acceleration zone B are provided with reference numeral 20'; the radial length of these mixing tools 20' increases steadily from the beginning of the acceleration zone B (that is, from the end of the induction zone A) to the end of the acceleration zone B (that is, to the beginning of the mixing zone C), as may be seen in the drawing.

Liquid feed pipes 33 (FIG. 1) or 34 (FIG. 2) intended particularly for adding glue to wood chips discharge into the acceleration zone B. In the form of embodiment shown in FIG. 1, the liquid feed pipes 33 terminate approximately at the inner wall, formed by the inner trough 2, of the conical portion 30 of the mixing vessel 1. The liquid can be supplied to these feed pipes either unpressurized, as is conventional and as is described in U.S. Pat. No. 4,183,676, or under pressure. In the latter case, atomizer nozzles 35 are disposed on the inner ends of the liquid feed pipes 33, in the manner described in U.S. Pat. No. 3,163,403, for example. As may be seen in FIG. 1, the liquid feed pipes 33 are disposed substantially in the forward section (with respect to the induction zone A) of the acceleration zone B.

In the form of embodiment shown in FIG. 2, the liquid feed pipes 34 protrude to varying extents into the interior 7 of the mixing vessel 1; the first liquid feed pipe 34', seen again from the induction zone A and looking in the material passage direction 31, extends the farthest away from the inner wall radially into the interior, while the next liquid feed pipes 34'', 34''' and 34'''' in sequence in the direction 31 of material passage extend progressively less far from the wall into the interior 7, and the last liquid feed pipe 34'''' terminates approximately at the inner wall itself. As in the first embodiment, the supply of liquid may be either not under pressure or under pressure; in each case, the outlet of the liquid is at the radially inwardly disposed end of the respective liquid feed pipe 34. In both exemplary embodiments, the liquid feed pipes 33 or 34 are located in the vertical axial plane of the mixing vessel 1.

In the exemplary embodiment of FIG. 2, the liquid outlet openings 36 are thus disposed on a line which, with the longitudinal axis 37 of the mixing vessel 1, forms an angle $\beta$, which in every case is clearly larger than $\alpha$. The angle $\beta$ measures approximately 20° to 25°.

Figure 3:
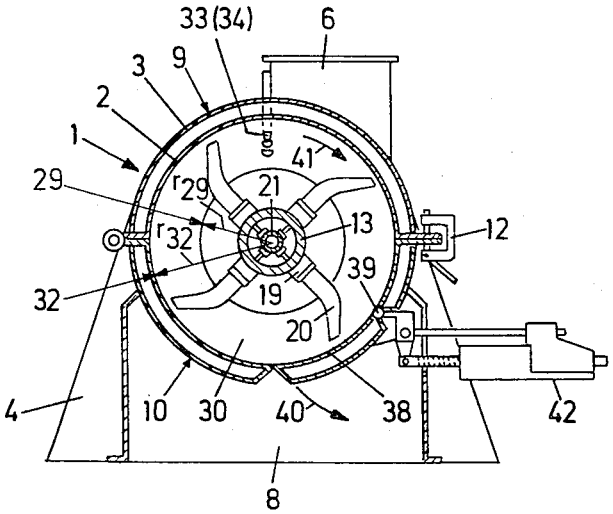
FIG. 3 shows a cross-section of the mixer according to FIGS. 1 and 2 along the line III—III in FIGS. 1 and 2.

A throttle valve 38 is disposed on the material outlet pipe 8 in a conventional manner; it is articulated at its upper, axially parallel edge by means of hinges 39 on the mixing vessel 1. The pressure of the material to be mixed moves the throttle valve 38 out of the closed position shown in FIG. 3, pivoting it downward and to the side as indicated by the arrow 40, so that the material outlet opening is opened to a greater to lesser extent. The mixing tools 20, in turn, moving in the rotary direction 41, propel the material centrifugally out through the mixture outlet opening, opened to a greater or lesser extent, and into the material outlet pipe 8. A counterweight 42 which can be adjusted by a motor is mounted on the outside of the throttle valve 38, as is described in detail in U.S. patent application Ser. No. 154,098. This motor-adjustable counterweight serves to augment the possibility (which exists in any event) that the throttle valve 38 will open in accordance with the pressure of the material to be mixed in the mixing vessel 1 with the further possibility of varying the closing pressure available at every open position of the throttle valve 38 by means of adjusting the counterweight 42.

The mixing of the material with liquid (that is, in particular the mixing of wood chips and glue) proceeds as follows:

The material introduced through the material inlet pipe 6 is propelled axially by the induction tools 27 or 28 into the acceleration zone B in the passage direction 31, undergoing a relatively slight tangential acceleration. Because of this predetermined axial propulsion, the material continues to pass through this zone B in an axial direction. At the same time, the material is increasingly accelerated tangentially by the mixing tools 20', so that out of a purely axial mixing movement a centrifugal mixing movement is brought about, in the course of which the material (as a rule, wood chips) is propelled centrifugally and helically over the full cross section of the mixing vessel in this region. The liquid (as a rule, glue) is introduced into this centrifugal and helical movement of the material, being either sprayed in or fed without pressure. In the manner of feeding shown in FIG. 2, the glue is fed through the first liquid feed pipe 34', which protrudes deeply into the mixing vessel 1, into the chips while they are still in the transition from axial mixing to centrifugal and helical mixing. Through the subsequent liquid feed pipes 34'', 34''' and 34'''', the glue is increasingly added to chips whose motion is more and more turbulent. Thus the glue is introduced in a region where the wood chips are steadily brought from a slow axial motion into a centrifugal and helical motion over a relatively long period of time; in other words, the transition is not overly abrupt, and the wood chips are thereby protected from damage. After the glue has been added, there is a further acceleration of the chips, so that a ring 43 of material again forms in the mixing zone C on the inner wall of the mixing vessel in the conventional manner; an intensive, thorough mixing of the wood chips and the glue takes place in this ring 43 of material.

The mixing shaft 13 is driven at high speed, so that at least in mixing zone C the prevailing rpm is far beyond the critical number. The critical rpm is defined as that at which an acceleration which equals that due to gravity engages the radially outwardly disposed ends of the mixing tools 20. In order to be able to exert corresponding forces of acceleration, the mixing tools 20 and 20' terminate in the vicinity of the inner wall of the mixing vessel 1. This is true particularly for the mixing tools 20 disposed in mixing zone C, because the material ring 43 is of course relatively thin in this zone, and the mixing tools 20 must protrude into this material ring 43 in order to be capable of continuously exerting acceleration forces on the wood chips forming the material ring 43.

Naturally, in the case where liquid or more specifically glue is added under pressure through the liquid feed pipes, compressed gas can be used as a supplementary aid to atomization.

Figure 4:
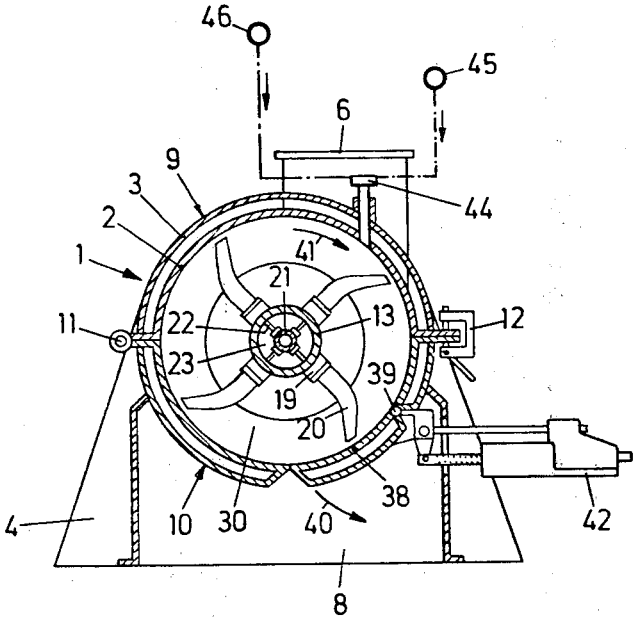
FIG. 4 shows a cross-section in accordance with FIG. 2 of a modified mixer.

Liquid feed nozzles 44 intended in particular for adding glue to wood chips discharge into the acceleration zone B (see FIG. 4), terminating close to the inside of the inner trough 2 of the mixing vessel 1; in other words, they do not protrude into the interior 7 of the mixing vessel 1. As may be seen in FIG. 4, these liquid feed nozzles 44 discharge substantially at a tangent into the interior 7. They are so-called dual-substance nozzles, by means of which both liquid glue, supplied by a glue supply line 45, and compressed air, supplied by a compressed-air line 46, are sprayed into the interior 7 with the finest possible distribution.

The centrifugal and helical movement of the chips is substantially reinforced by the air sprayed through the liquid feed nozzles 44. The air serves not only as a carrier medium for the glue (that is, as a means of atomizing the glue), but contributes quite substantially to loosening up of the chips as well.

The compressed air is supplied to the liquid feed nozzles 44 at a pressure in the range of from 2 to 6 bar, preferably at a pressure of from 2.5 to 4 bar.

At an average specific weight of the wood chips of 100 kg/m$^3$, compressed air is supplied to the liquid feed nozzles 44 at a ratio of from 2 to 5 Norm m$^3$/m$^3$ of chips; the ratio is preferably 2.5 to 3.5 Norm m$^3$/m$^3$ of air per m$^3$ of chips.

Figure 5:
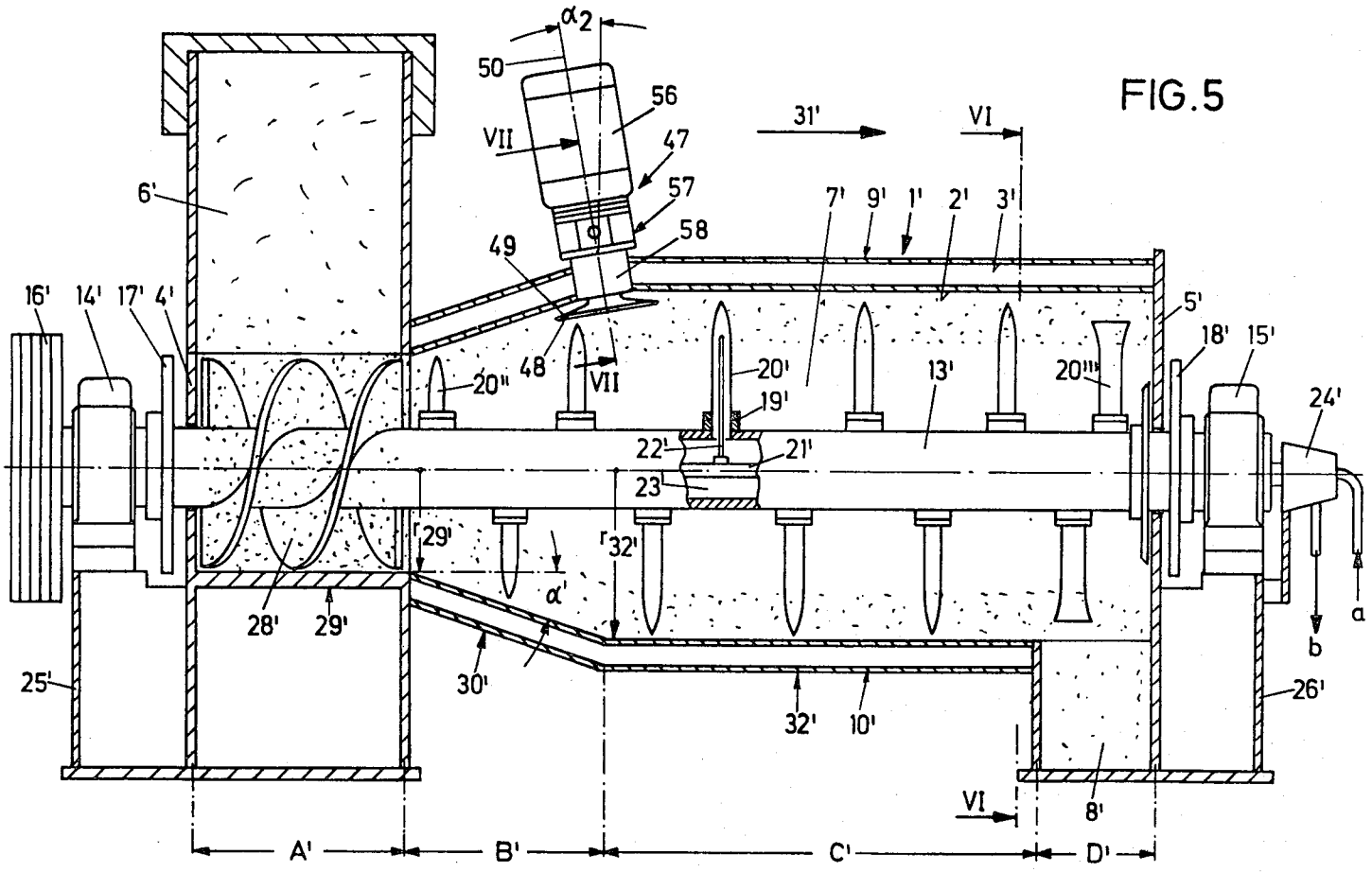
FIG. 5 shows a further mixer in accordance with the invention in a vertical lengthwise section.
Figure 6:
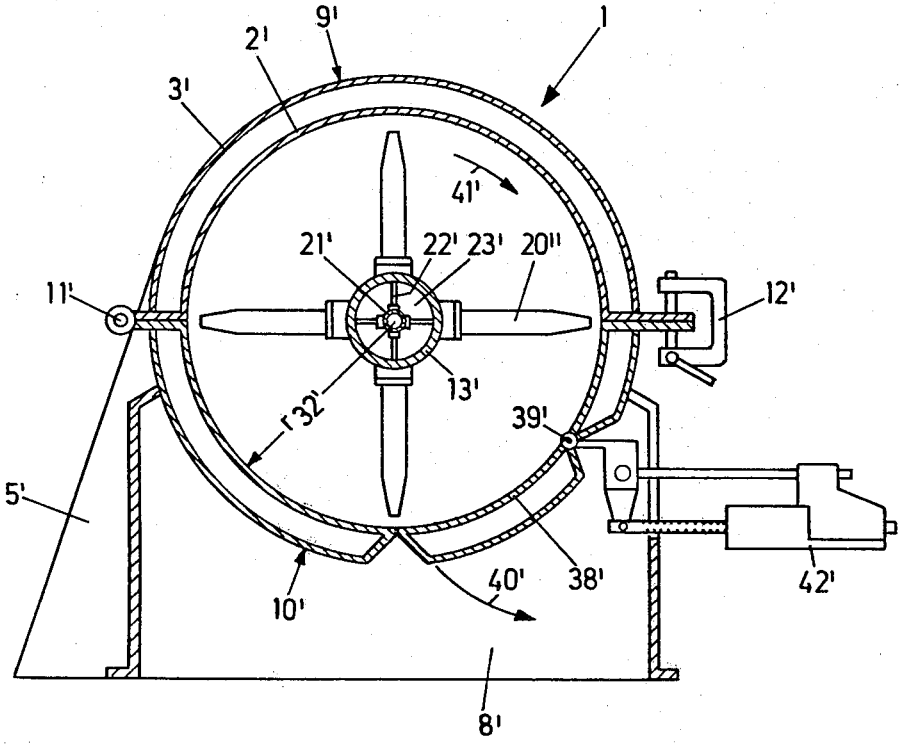
FIG. 6 is a cross-section taken through the mixer along the line VI—VI of FIG. 5.
Figure 7:
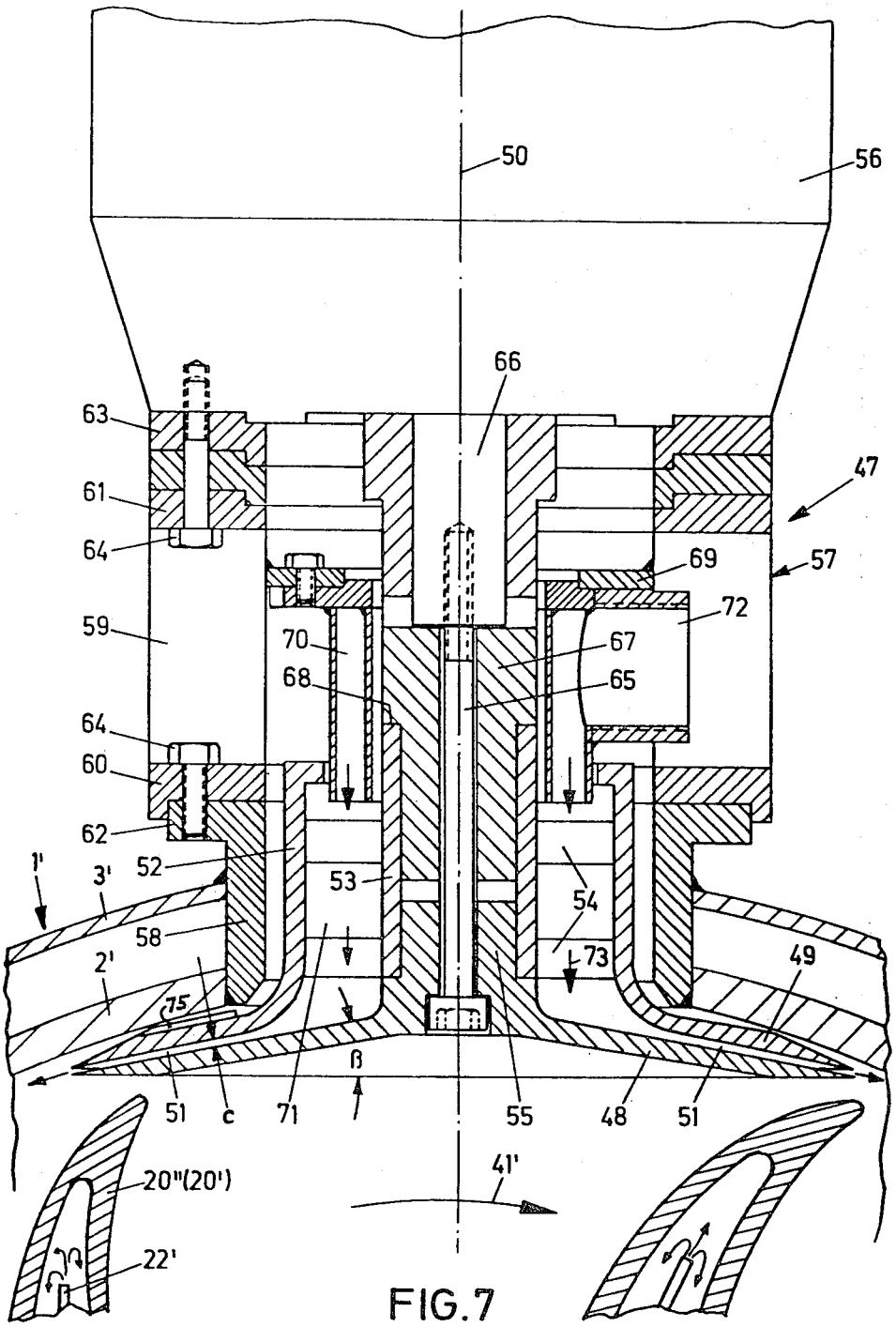
FIG. 7 is a cross-section taken through a glue feed device of the mixer along the line VII—VII of FIG. 5.

Since the mixer shown in FIGS. 5–7 is identical in its basic design to that of FIG. 2, it need not be described fully. Comparable parts are identified by identical reference numerals, with the addition of a prime.

In the exemplary embodiment shown in FIGS. 5–7, the conical portion 30' widens from radius $r_{29'}$ to radius $r_{32'}$ of the cylindrical portion 32'. The ratio of the radii $r_{29'}$ to $r_{32'}$ is between 0.55 and 0.7 to 1 and preferably approximately between 0.6 and 0.65 to 1. The conical apex angle $\alpha$ of the conical portion 30' is approximately 12° to 20° and preferably approximately 18°. The ratio of the axial length of acceleration zone B' to the axial length of mixing zone C' is approximately 1:2. In accordance with the conical path of the inner wall of the mixing vessel 1' in the conical portion 30', the mixing tools here as well are embodied as substantially shorter in radial length than in the cylindrical portion 32'. For this reason, the mixing tools present in this acceleration zone B' are identified by reference numeral 20''; the radial length of these mixing tools 20'' increases approximately steadily from the beginning of the acceleration zone B' (that is, from the end of the induction zone A'), up to the end of the acceleration zone B' (that is, up to the beginning of the mixing zone C', as may be seen from FIG. 5.

In the expulsion zone D', the mixing tools are embodied in approximately vanelike fashion in order to generate tangential movements on the part of the material to be mixed, and they are therefore identified by reference numeral 20'''.

In acceleration zone B', which in the illustrated exemplary embodiment is at the transition from the conical portion 30' to the cylindrical portion 32', a glue feed device 47 is provided, which functions centrifugally. It has two centrifugal plates which are interconnected in a rotationally fixed manner; these are an inner centrifugal plate 48 and an outer centrifugal plate 49, which between them define a substantially radial gap 51 relative to the central longitudinal axis 50 of the glue feed device 47. The outer centrifugal plate 49, oriented toward the inner wall of the mixing vessel 1, adjoins a tubular portion 52 in which a likewise tubular centering portion 53 is fixedly disposed by means of several radial crosspieces 54. The inner centrifugal plate 48 has a centering shoulder 55, by means of which it is held both radially and axially within the tubular centering portion 53. The width c of the gap 51, which is substantially in the form of an annular plate, may be varied by provision of an appropriate length of the tubular centering portion 53 or by means of interposing shims at the joint between the centering shoulder 55 and the centering portion 53.

A conventional electromotor 56 serves to drive the centrifugal plates 48, 49; it is screwed on a short support frame 57, which is screwed in turn on a pipe fitting 58 passing to the outside through the inner trough 2' and the cooling jacket 3' of the mixing vessel 1'. The inner diameter of the pipe fitting 58 is somewhat larger than the outer diameter of the tubular portion 52. The support frame 57 comprises several crosspieces 59, extending parallel to the axis 50, and annular flanges 60, 61 attached at either end, which are releasably fastened by means of screws 64 to a corresponding flange 62 of the pipe fitting 58 and to the attachment flange 63 of the electromotor 56, respectively.

The centrifugal plates 48, 49 are screwed in a rotationally fixed manner to the shaft protrusion 66 of the motor 56 by means of a threaded screw which passes through the centering shoulder 55 coaxially with the axis 50. A spacer 67 is provided, which is supported axially against the shaft protrusion 66 on one end and on the other end engages the inside of the centering portion 53. The centering portion 53 is axially supported via a shoulder 68 against the spacer 67, so that when the threaded screw 65 is tightened, the inner centrifugal plate 48 is clamped with its centering portion 53 to the outer centrifugal plate 49 and thus the latter element is also clamped firmly to the shaft protrusion 66. The centrifugal plates are thereby fixed axially, while the width c of the gap 51 is fixed at the same time, and the two centrifugal plates are connected to the shaft protrusion 66 in a rotationally fixed manner.

An annular plate 69 is secured on the crosspieces 59 in the vicinity of the annular flange 61 oriented toward the electromotor 56, and an annular-cylindrical channel 70 which is closed in the direction of the annular plate 59 is screwed onto the plate 69. The annular-cylindrical channel 70 discharges freely into the glue chamber 71 between the tubular portion 52 and the centering portion 53. A threaded fitting 72 discharges laterally into the annular channel 70, and a glue supply line (not shown) may be attached to the threaded fitting 72.

As may be seen in FIG. 7, the gap 51 does not have an exactly radial course; instead, it has the form of a truncated cone with a very large apex angle, that is, a very small base angle $\beta$ of approximately 5° to 10°, which corresponds to an apex angle of 170° or 160°. The base angle $\beta$ may be selected, by way of example, such that it is equal to $\alpha'/2$, if the glue feed device 47 is disposed at the transition from the conical portion 30' to the cylindrical portion 32'. In this case, the glue feed device 47 is disposed such that its longitudinal axis 50 is inclined, with respect to the lengthwise section of the mixer shown in FIG. 5, at an angle of $\alpha'/2$.

The introduction of glue into zone B' is effected in such a manner that glue is fed in a metered fashion into the annular channel 70 by a pump, not shown, via a glue supply line, also not shown. From the annular channel 70, the glue flows downward into the glue chamber 71, as indicated by arrows 73. Particularly on the upper part of the inner centrifugal plate 48, the glue undergoes strong radial acceleration and is driven through the gap 51, leaving this gap in the form of a fine mist having a very high tangential velocity. The speed of the centrifugal plates is conventionally 2800 rpm; given a diameter for the centrifugal plates 48, 49 of 140 mm, this translates into velocity at the circumference of the centrifugal plates at the outlet of the gap 51 of somewhat more than 20 m/sec. The glue is thus distributed extremely finely and at a very high velocity into the material, that is, into the chips in particular. A portion of the glue is deposited on the inner wall of the inner trough 2', particularly in the conical portion 30'. Since the mixer is well cooled, the inner wall has a relatively low temperature, so that water condenses on the wall and thins the deposited glue. This glue can thus be absorbed particularly easily by the wood chips flowing past it. Since coarse chips or dust is more likely to be located in the vicinity of the wall rather than fine chips or dust, these coarse chips are thereby glued relatively more heavily, which is desirable.

Approximately at the beginning of the mixing zone C', a ring 74 of mixing material forms on the inner wall of the mixing vessel 1'. Here, an intensive, thorough mixing of the wood chips and glue takes place.

As may be seen from FIG. 7, the mixing tools 20'' or 20' pass inside the inner centrifugal plate 48 in the vicinity of the glue feed device 47. Should the material ring 74 already be taking form in its initial stages in this region of the mixing vessel 1, then it would pass near by the inner side of the inner centrifugal plate 48. Because of the fact that the outer centrifugal plate 49 is driven at high speed, no chips are able to get into the space between the inner wall of the inner trough 2' and the centrifugal plate 49, which is only a few millimeters wide. If such a ring is already partially forming, then the mist of glue is applied from the outside onto this material ring.

The glue feed device 47 may be supplied with glue without pressure; as a result, a particularly precise metering of glue is made possible in a known manner.

It may also be seen from FIG. 7 that the centrifugal plates 48, 49 are tapered in their outer circumference down to the outlet of the gap, so that as a unit the centrifugal plates have no annular-cylindrical rim on which material to be mixed (that is, chips) could back up. The chips are thus able to pass smoothly by the inner side of the inner centrifugal plate 48.

As may be seen in FIG. 7, a crosspiece-like fan blade 75 may be disposed on the outer centrifugal plate 49, which improves the cleaning action of the rotating centrifugal plate 49 with respect to the inner wall of the inner trough 2'.

It will be obvious to those skilled in the art that various changes may be made without departing from the scope of the invention, and the invention is not to be considered limited to what is shown in the drawings and described in the specification.

What is claimed is:

1. A method for mixing of particulate solids with liquids, in particular for gluing wood chips or the like, wherein there is an intensive movement of the solids during the addition of the liquid and a subsequent thorough mixing of the liquid and the solids in a ring of material to be mixed, characterized in that the solids are steadily accelerated out of an axial motion via a centrifugal and helical motion and the addition of liquid is effected during this acceleration, and that the acceleration to the velocity of the ring of material to be mixed takes place only following the addition of the liquid.

2. A method as defined by claim 1, characterized in that the solids are spread apart conically during the acceleration.

3. A method as defined by claim 1, characterized in that the liquid is sprayed into the solids with air as a carrier means for the liquid.

4. A method as defined by claim 1, characterized in that the liquid is supplied to the solids from the outside in the form of a mist sprayed in approximately disclike fashion.

5. A method as defined by claim 4, characterized in that the liquid is accelerated within a gap rotating at high speed and having an approximately annular disc-like form.

6. An apparatus for performing the method as defined by claim 1, having a mixing vessel in which a mixing shaft capable of being driven at high speed and equipped with mixing tools is disposed, which vessel is provided at one end, in the vicinity of an induction zone for the solids, with a material inlet pipe and at the other end with a material outlet pipe, and which vessel is provided in a region following the induction zone with at least one liquid feed device and has a mixing zone in a further following region, in which mixing zone the liquid/solids mixture mixed in the form of a ring of material to be mixed, characterized in that disposed between the induction zone (A) and the mixing zone is an acceleration zone (B) formed by a portion (30) of the mixing vessel (1) which widens in conical fashion in the direction (31) of passage of the material through the vessel, in which acceleration zone (B) the radial length of the mixing tools (20') steadily increases.

7. An apparatus as defined by claim 6, characterized in that the ratio of the radius ($r_{29}$) of the cylindrical portion (29) of the mixing vessel (1) forming the induction zone (A) to the radius ($r_{32}$) of the cylindrical portion (32) of the mixing vessel forming the mixing zone (C) amounts to between 0.6 and 0.8 to 1.

8. An apparatus as defined by claim 6, characterized in that the conical portion (30) of the mixing vessel (1) has an apex angle ($\alpha$) of 8° to 15°.

9. An apparatus as defined by claim 6, characterized in that the liquid feed devices (44) are embodied as dual-substance nozzles.

10. An apparatus as defined by claim 6, characterized in that the liquid feed device (47) has a gap (51) defined by two rotationally drivable centrifugal plates (48, 49), the gap being open at its outer circumference and having an approximately annular-disc-like form, of narrow width (c), the outer centrifugal plate (49) being disposed at an immediately adjacent distance from the inner wall of the mixing vessel (1).

11. An apparatus as defined by claim 10, characterized in that the distance (c) between the centrifugal plates (48, 49) is adjustable.

12. An apparatus as defined by claim 10, characterized in that an electromotor (56) is flanged to the outside of the mixing vessel (1), with the motor shaft protrusion (66) of which the centrigual plates (48, 49) are directly connected.

13. An apparatus as defined by claim 10, characterized in that a locally stationary annular channel (70) for liquid supply discharges into a liquid chamber (71) embodied at the centrifugal plates (48, 49) and discharging in the gap (51).

14. An apparatus as defined by claim 10, wherein the outer centrifugal plate adjacent to the wall of the mixing vessel is drivable, characterized in that the outer centrifugal plate (49) has at least one fan blade (75) extending up to the vicinity of the wall.

* * * * *

UNITED STATES PATENT AND TRADEMARK OFFICE

CERTIFICATE OF CORRECTION

PATENT NO. : 4,390,285

DATED : June 28, 1983

INVENTOR(S) : DURR et al

It is certified that error appears in the above-identified patent and that said Letters Patent are hereby corrected as shown below:

On the title page, Foreign Application Priority Data reading "Aug. 24, 1980 [DE] Fed. Rep. of Germany .....3032039" should read -- Aug. 26, 1980 [DE] Fed. Rep. of Germany .....3032039 --.

Signed and Sealed this

Seventh Day of February 1984

[SEAL]

*Attest:*

GERALD J. MOSSINGHOFF

*Attesting Officer*

*Commissioner of Patents and Trademarks*